US012233310B2

(12) United States Patent
Xu et al.

(10) Patent No.: US 12,233,310 B2
(45) Date of Patent: Feb. 25, 2025

(54) TREADMILL PLATFORM FOLDING MECHANISM OF TREADMILL

(71) Applicant: Zhejiang Changrong Industry and Trade Co., Ltd, Jinhua (CN)

(72) Inventors: Wenming Xu, Jinhua (CN); Peng Yang, Jinhua (CN)

(73) Assignee: Zhejiang Changrong Industry and Trade Co., Ltd., Jinhua (CN)

( * ) Notice: Subject to any disclaimer, the term of this patent is extended or adjusted under 35 U.S.C. 154(b) by 119 days.

(21) Appl. No.: 18/316,795

(22) Filed: May 12, 2023

(65) Prior Publication Data

US 2023/0277895 A1 Sep. 7, 2023

(51) Int. Cl.
*A63B 22/02* (2006.01)

(52) U.S. Cl.
CPC ..... *A63B 22/02* (2013.01); *A63B 2210/50* (2013.01)

(58) Field of Classification Search
CPC . A63B 22/0046; A63B 22/02; A63B 71/0036; A63B 2210/50; A63B 2225/09
See application file for complete search history.

(56) References Cited

U.S. PATENT DOCUMENTS 11,779,800 B2 * 10/2023 Jiang ..... A63B 22/0235 482/54
2010/0240497 A1 9/2010 Wu
2012/0071299 A1 3/2012 Yang
2017/0106233 A1 4/2017 Yang
2020/0215380 A1 * 7/2020 Xing ..... A63B 22/025
2023/0014949 A1 * 1/2023 Jiang ..... A63B 22/0235

FOREIGN PATENT DOCUMENTS

CN 107349562 A * 11/2017 ..... A63B 22/0235
CN 110270052 A * 9/2019 ..... A63B 22/0235
CN 110624210 A * 12/2019 ..... A63B 22/02
CN 112973091 A * 6/2021 ..... A63B 22/02
CN 114191777 A * 3/2022
CN 216798610 U * 6/2022

* cited by examiner

*Primary Examiner* — Gary D Urbiel Goldner
(74) *Attorney, Agent, or Firm* — Hemisphere Law, PLLC; Zhigang Ma

(57) ABSTRACT

The present disclosure provides a treadmill platform folding mechanism of a treadmill. The treadmill platform folding mechanism of the treadmill includes: two base frames, running decks, and a hinge; opposite openings are formed in two ends of opposite sides of the two base frames; one running deck is fixed on each of the two base frames; the hinge includes two hinge bodies; each hinge body includes a hinge seat, a hinge shaft, a hinge piece, and a sliding shaft; one end of the hinge seat of the single hinge body is plugged into the opening of the corresponding base frame, and a bolt vertically passes through the base frame and the hinge seat for fixing; the hinge shafts are arranged on upper sides of unfixed ends of the two hinge seats; sloping-upward strip-shaped through slots are also formed in the two hinge seats.

2 Claims, 2 Drawing Sheets

TREADMILL PLATFORM FOLDING MECHANISM OF TREADMILL

TECHNICAL FIELD

The present disclosure relates to a treadmill platform folding mechanism of a treadmill.

BACKGROUND

A treadmill platform of a treadmill includes a base frame and a running deck. In order to reduce a packaging volume of a treadmill and facilitate transportation, treadmill platforms of some existing treadmills are foldable in half. For example, a treadmill platform folding mechanism of a treadmill No. CN216798610U includes two base frames, running decks, and hinges. Each base frame is provided with one running deck. A square gap is formed in each of two ends of opposite sides of the two running decks. The base frames at lower ends of the square gaps are also welded with hinge fixing plates extending to positions below the running decks, and the hinges are arranged on the two hinge fixing plates. The existing treadmill platform folding mechanism of the treadmill has a large hinge volume, so that the hinges cannot be directly fixed to the two base frames. Instead, hinge fixing plates need to be welded on inner sides of the base frames, and gap are formed by cutting the two ends on the opposite sides of the two running decks to reserve a space for mounting the hinges. This damages the integrity of the running decks. Each hinge is composed of two U-shaped hinge seats and a plurality of forked hinge pieces cross connected between the two hinge seats. Relative horizontal sliding chutes are also formed in inner walls of the two hinge seats, and the plurality of forked hinge pieces are connected in the two horizontal sliding chutes of the two U-shaped hinge seats by hinge shafts I, hinge shafts II, sliding pins, and nylon sliders, so that the structure of the mechanism is complicated, and the mounting is very inconvenient.

SUMMARY

In view of the defects of the existing treadmill platform folding mechanism of a treadmill, the technical problem to be solved in the present disclosure is to provide a treadmill platform folding mechanism of a treadmill, which is simple in structure and convenient to mount, does not damage the overall structure of running decks, and saves more costs.

In order to achieve the above objective, according to one aspect of the present disclosure, the present disclosure is achieved by the following technical measures: A treadmill platform folding mechanism of a treadmill includes two base frames, running decks, and a hinge;

- opposite openings are formed in two ends of opposite sides of the two base frames; one running deck is fixed on each of the two base frames;
- the hinge includes two hinge bodies; each hinge body includes a hinge seat, a hinge shaft, a hinge piece, and a sliding shaft;
- one end of the hinge seat of the single hinge body is plugged into the opening of the corresponding base frame, and a bolt vertically passes through the base frame and the hinge seat for fixing; the hinge shafts are arranged on upper sides of unfixed ends of the two hinge seats; sloping-upward strip-shaped through slots are also formed in the two hinge seats;
- the sliding shafts are plugged into the strip-shaped through slots;

- the hinge pieces are arc-shaped; the hinge pieces are located on outer sides of the hinge seats; one end of each hinge piece is movably fixed with each hinge shaft, and the other end is movably fixed with the sliding shaft of the other hinge seat; and middle portions of the hinge pieces of the two hinge bodies are fixed by connecting shafts.

Further, opposite semicircular gaps are also formed in the hinge seats of the two hinge bodies; and the semicircular gaps are used for clamping the hinge shafts. The above structure is more reasonable.

Compared with the prior art, the present disclosure has the advantages that: By the design of the two hinge pieces, during the mounting of the hinge pieces, it is not necessary to mount the hinge shafts, the sliding shafts, and the connection shafts in a limited space like the existing U-shaped hinge seats. The treadmill platform folding mechanism of the treadmill is simple in structure and convenient to mount, does not damage the overall structure of the running decks, and saves more costs.

BRIEF DESCRIPTION OF THE DRAWINGS

The drawings constituting one part of the present disclosure are used to provide a further understanding of the present disclosure. Illustrative embodiments and descriptions thereof of the present disclosure are used to explain the present disclosure, and do not constitute an improper limitation to the present disclosure. In the drawings.

Figure 1:
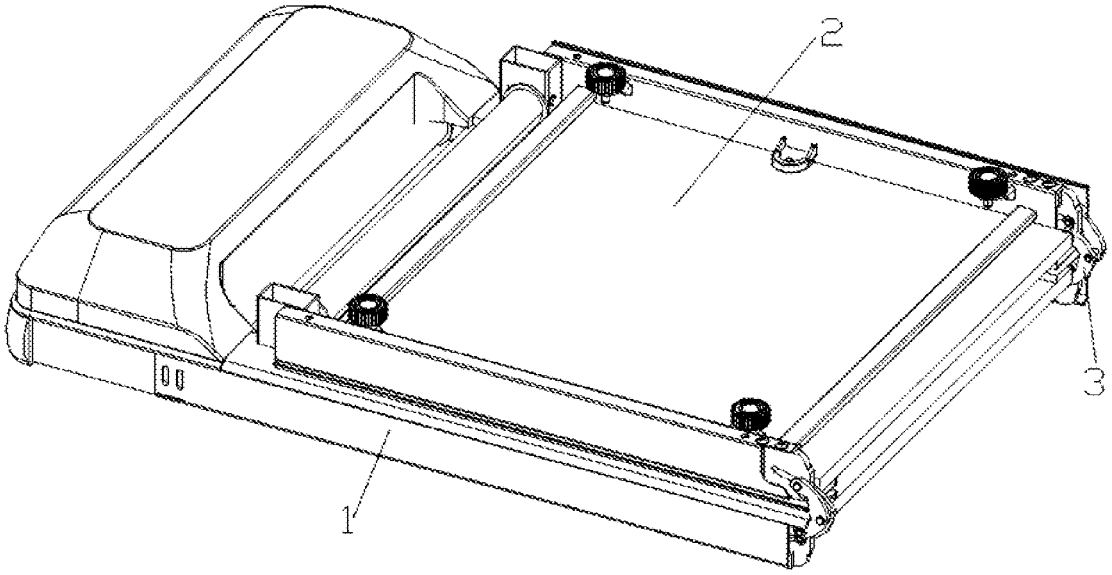
FIG. 1 is a schematic structural diagram of a treadmill platform folding mechanism of a treadmill according to the present disclosure.

Numerals in the drawings: 1: base frame; 2: running deck; 3: hinge; 4: opening; 5: bolt hole I; 6: hinge seat; 7: hinge shaft; 8: hinge piece; 9: sliding shaft; 10: bolt hole II; 11: strip-shaped through slot; and 12: connection shaft.

DETAILED DESCRIPTION OF THE EMBODIMENTS

The present disclosure will be described in detail below with reference to the accompanying drawings and in combination with embodiments. It should be noted that the embodiments of the present disclosure and features in the embodiments may be combined with each other without conflicts.

In the description of the present disclosure, it should be understood that orientations or positional relationships indicated by the terms "center", "upper", "lower", "left", "right", "vertical", "horizontal", "inside", "outside", "bottom", "top", and the like are orientations or positional relationships as shown in the drawings, and are only for the purpose of facilitating and simplifying the description of the present disclosure instead of indicating or implying that devices or elements indicated must have particular orientations, and be constructed and operated in the particular orientations, so that these terms are not construed as limiting the present disclosure.

Embodiment 1

Referring to FIG. 1, a treadmill platform folding mechanism of a treadmill provided by this embodiment includes two base frames 1, running decks 2, and a hinge 3. The two base frames 1 are oppositely arranged on the left and right and can be folded to each other.

Figure 2:
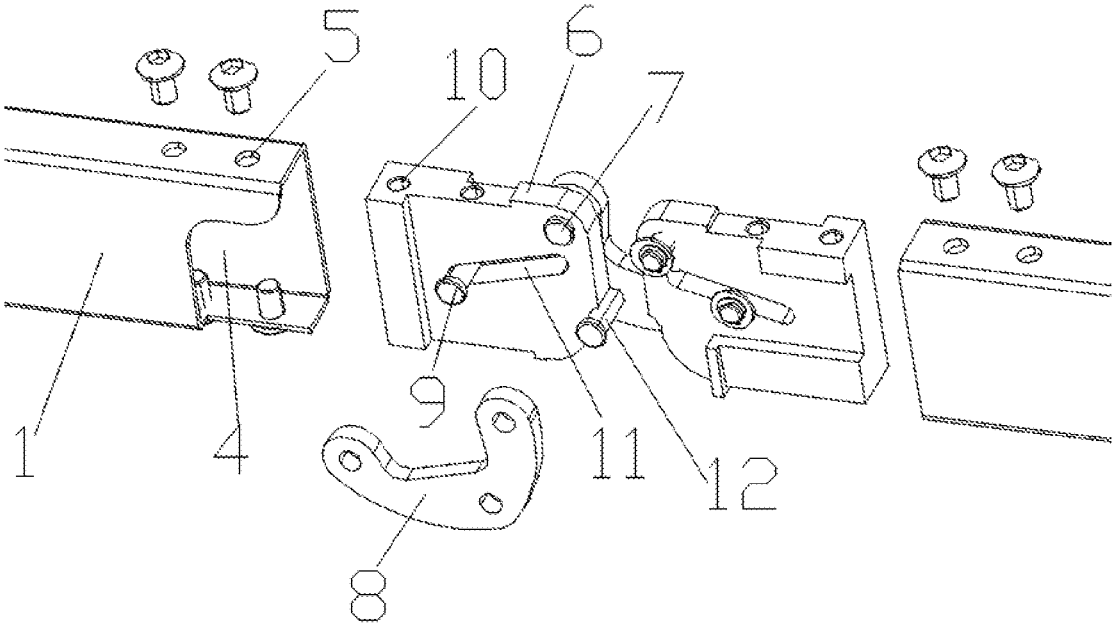
FIG. 2 is a schematic structural diagram of a hinge of the present disclosure.

Continue to refer to FIG. 2, openings 4 are formed in inner and outer ends of opposite sides of the two base frames 1. Opposite bolt holes I 5 are formed in upper and lower ends of the openings 4. One running deck 2 is fixed on each of the two base frames 1. The hinge includes two hinge bodies. Each hinge body includes a hinge seat 6, a forked hinge piece 8, a hinge shaft 7, and a sliding shaft 9. The hinge seat 6 is a flat cubic aluminum alloy block. An outer side of the hinge seat 6 is plugged into the opening 4 of the corresponding base frame 1, and a vertical bolt hole II 10 is formed in the hinge seat 6 on this side. Bolts passes through the bolt holes I 5 and the bolt hole II 10 to fix the base frame 1 and the hinge seat 6. Each hinge shaft 7 is fixed at an upper end of an inner side of the hinge seat 6. A sloping-upward strip-shaped through slot 11 is formed in the hinge seat 6. Each sliding shaft 9 is plugged into the strip-shaped through slot 11. The hinge piece 8 is arc-shaped. Holes are formed in two sides of an upper end and a center of a lower end of the hinge piece 8. The hole in the outer side of the upper end of the hinge piece 8 is movably fixed with the hinge shaft 7, and the hole in the inner side of the upper end is movably fixed with the sliding shaft 9 of the other hinge seat 6. In this way, when the two hinge pieces 8 are used, one sliding shaft 9 slantways moves down, and the other sliding shaft slantways slides up. the holes in the centers of the lower ends of the two hinge pieces 8 are connected by a connection shaft 12. In order to make the structure more compact, semicircular gaps are also formed in lower ends of the opposite sides of the two hinge seats 6. The semicircular gaps are used for clamping the connection shafts 12. In addition, when a base is placed horizontally, the connection shafts 12 are clamped outside the semicircular gaps of the hinge seats to achieve a limiting effect.

According to the treadmill platform folding mechanism of the treadmill provided in this embodiment, the two hinge seats 6 of the hinge are flat cubes and are plugged into square tubes of the base frames 1. The bolts pass through the bolt holes I 5 of the base frames 1 and are then fixed on the bolt holes II 10 of the hinge seats 6. The two hinge seats 6 are provided with opposite inclined strip-shaped through slots 11. One end of each of the two forked hinge pieces 8 is hinged with the corresponding hinge seat 6, and the other end is connected into the strip-shaped through slot 11 of the opposite hinge seat 6 through the sliding shaft 9. The lower ends of the two hinge pieces 8 are connected through the connection shafts 12. In an unfolded usage state of the treadmill, opposite ends of the two hinge seats 6 resist against each other, and the connection shafts 12 between the two forked hinge pieces 8 are limited in the semicircular gaps in the opposite sides of the two hinge seats 6, so that the opposite sides of the two hinge seats 6 tightly resist. Meanwhile, the upper ends of the two hinge seats 6 are kept horizontal. If one end of the treadmill platform is upwards flipped for folding, the two forked hinge pieces 8 of the hinge separately rotate around the hinge shafts 12 of the hinge seats 6. In addition, the sliding shafts 9 of the forked hinge pieces 8 slide along the strip-shaped through slots 11 of the opposite hinge seats 6.

After the adoption of the above structure, by the design of the two hinge pieces in the treadmill platform folding mechanism of the treadmill provided by this embodiment, during the mounting of the hinge pieces, it is not necessary to mount the hinge shafts, the sliding shafts, and the connection shafts in a limited space like the existing U-shaped hinge seats. The treadmill platform folding mechanism of the treadmill is simple in structure and convenient to mount, does not damage the overall structure of the running decks, and saves more costs.

The above descriptions are only preferred embodiments of the present disclosure, and are not intended to limit the present disclosure. For those skilled in the art, the present disclosure can have various changes and variations. Any modification, equivalent replacement, improvement, etc. made within the spirit and principle of the present disclosure shall all fall within the protection scope of the present disclosure.

What is claimed is:

1. A treadmill platform folding mechanism of a treadmill, comprising two base frames, two running decks, and a hinge, wherein:

opposite openings are respectively formed in two ends of opposite sides of the two base frames; one running deck is fixed on each of the two base frames;

the hinge comprises two hinge bodies; each hinge body comprises a hinge seat, a hinge shaft, a hinge piece, and a sliding shaft;

one end of the hinge seat of the single hinge body is plugged into the opening of the corresponding base frame, and a bolt vertically passes through the base frame and the hinge seat for fixing; the hinge shafts are respectively arranged on upper sides of unfixed ends of the two hinge seats; sloping-upward strip-shaped through slots are also respectively formed in the two hinge seats;

the sliding shafts are respectively plugged into the sloping-upward strip-shaped through slots; and the hinge pieces are arc-shaped; the hinge pieces are respectively located on outer sides of the hinge seats; one end of each hinge piece is movably fixed with each hinge shaft, and another end of each hinge piece is movably fixed with the sliding shaft of the other hinge seat; and middle portions of the hinge pieces of the two hinge bodies are respectively fixed by connecting shafts.

2. The treadmill platform folding mechanism of the treadmill according to claim 1, wherein opposite semicircular gaps are also respectively formed in the hinge seats of the two hinge bodies; and the semicircular gaps are used for respectively clamping the hinge shafts.

* * * * *